US005484209A

United States Patent [19]

Weng

[11] Patent Number: 5,484,209

[45] Date of Patent: Jan. 16, 1996

[54] STEEL BALL BEARING SLIDING MECHANISM FOR DRAWERS

[76] Inventor: Kvo-Chan Weng, No. 196, Shin-Juang Lii, Tuu-Kuh Jenn, Yun-Lin Hsien, Taiwan

[21] Appl. No.: 176,574

[22] Filed: Dec. 30, 1993

[51] Int. Cl.[6] ..... F16C 29/04

[52] U.S. Cl. ..... 384/18

[58] Field of Search ..... 384/18, 19, 21, 384/22, 49; 312/334.17

[56] References Cited

U.S. PATENT DOCUMENTS

| | | | |
|---|---|---|---|
| 4,119,377 | 10/1978 | Barber et al. | 384/22 |
| 4,440,462 | 4/1984 | Manson | 384/18 |
| 5,085,523 | 2/1992 | Hobbs | 384/18 |
| 5,181,782 | 1/1993 | Wojcik | 384/18 |

*Primary Examiner*—Lenard A. Footland

*Attorney, Agent, or Firm*—Lowe, Price, LeBlanc & Becker

[57] ABSTRACT

The present invention provides a steel ball bearing sliding mechanism for drawers, particularly to a easy-to-use, well-aligned drawer sliding mechanism. It mainly consists of a sliding rail having a retaining plate movably connected thereto. The slits and the shoulder portion of the retaining plate are provided to interlock with the protruded point and the stair portion of the blocking member connected to the intermediate rail, so as to prevent the drawer from misalignment and disengagement. Moreover, the drawer can be pulled out with ease by pressing the retaining plate. The sliding mechanism according to the present invention delivers a smooth, effortless, and whisper-quiet opening and closing of the drawer.

4 Claims, 12 Drawing Sheets

STEEL BALL BEARING SLIDING MECHANISM FOR DRAWERS

BACKGROUND OF THE INVENTION (a) Field of the Invention

The present invention relates to a ball bearing sliding mechanism for drawers, particularly to a steel ball bearing type sliding drawer mechanism in which the sliding rail is movably connected to a retaining plate, such that the slits and the shoulder portion provided in the retaining plate are respectively retained with the protruded point and the stair portion of the blocking member, thereby preventing the drawers from falling off. The drawer can be pulled out and removed quickly by pressing the retaining plate, enhancing the alignment and the operation of the drawer.

(b) Description of the Prior Art

File cabinets with sliding drawers are used to store files and documents in the office. Since the files and documents are shared by a lot of users, the opening and closing of the drawers are quite frequent. Therefore, the smooth operation and the sturdiness of the sliding mechanism of the drawer relate to how well the files are organized in the drawer. In other words, if the sliding mechanisms of the drawer cannot be effectively aligned and sturdily suspended, then the drawer can be tipped over when it is extended, causing bodily injury or messing up the files. As shown in FIG. 1, the conventional ball bearing sliding mechanism mainly consists of a sliding rail (11), a retaining plate (13) and an intermediate rail (21). The sliding rail (11) is provided with a positioning holes (12). The retaining plate (13) is connected to one side of the sliding rail (11). The retaining plate (13), having an appropriate shape, consists of a holding rod (131). One side of the holding rod (131) has a resilient plate (132) connected thereof, and the other side of which is provided with a protruding retaining block (133). A securing hole (134) is provided in a suitable position of the retaining plate (134). The securing hole is also provided with rivet (135) for securing the retaining plate (13) through the positioning hole (12) to the sliding rail (11). The intermediate rail (21), having an appropriate shape, is provided with a holding block (22). The holding block (22) is provided with a protruded block (23) in a suitable position such that when the sliding rail (11) slides out, the protruded block (23) is retained with the retaining block (133) of the retaining plate (13).

The above configuration of the conventional sliding drawer mechanism is capable to interlock the sliding rail (11), however, there are some drawbacks in the operation:

1. When the sliding rail (11) is engaged with the intermediate rail (21), as is shown in FIG. 2A, the edge of the retaining block (133) of the retaining plate (13) comes in contact with the protruded block (23) of the intermediate rail (21). Therefore, when the retaining plate (13) is pushed forward, the protruded block (23) of the intermediate rail (21) presses onto the retaining block (133) of the retaining plate (13), thereby deforming the resilient plate (132) of the retaining plate (13). This forces the retaining plate (13) to pass underneath the protruded block (23) so that the sliding rail (11) slides into the intermediate rail (21). Hence, under a prolonged operation, the pressing from the top edge of the protruded block (23) onto the side of the retaining block (133) can cause wears and tears on the protruded block (23) or the retaining block (133). Therefore, the component of the retaining plate can be damaged for extended operation and this is definitely one of the drawbacks of this structure.

2. When the sliding rail (11) needs to be pulled out, as is shown in FIG. 2B, the retaining plate (13) is retained with the protruded block (23) of the intermediate rail (21), therefore, the holding rod (131) of the retaining plate (13) has to be pushed downward, thereby allowing the retaining block (133) of the retaining plate (13) to displace downward and disengage from the protruded block (23). However, the retaining block (133) is not moving downward in a lateral direction, instead, it slides downward in a path of an arc. Hence, the frequent usage of the device causes the retaining block (133) or the protruded block (23) to wear out. In addition, the top of the retaining block (133) can also be worn out to have a circular arc shape, making it fails to retain with the protruded block (23) and affecting the alignment of the drawer. This inconvenience in operation is the second disadvantage of the conventional sliding mechanism.

3. The conventional sling drawer sliding mechanism provides an interlocking of the retaining plate (13) and the protruded block (23) of the intermediate rail. This is only a one-way interlocking to prevent the drawer to slide out by itself. It cannot hold the drawer in place. Any touching on the drawer can cause it to slide towards the inner side, causing a lot of inconveniences in operation. This is the third disadvantage.

The Inventor, with many years of experience in the manufacturing and design of such product, has come up with an improved structure for the drawer sliding mechanism which is simple and convenient to use, easy to operate and gives a perfect interlocking.

SUMMARY OF THE INVENTION

The main object according to the present invention is to provide a drawer sliding mechanism as recited in claim 1 of this claim, in which the sliding rail is movably connected to a retaining plate. Characterized in that the retaining plate is provided with a pressed plate and a blocked plate, the joint from the two is provided with a shoulder portion. In addition, slits are opened on the two sides of the blocked plate. The blocked plate and the pressed plate are also provided with positioning holes. The two ends of the blocked plate and the pressed plate are also extended and connected to a resilient plate.

Another object according to the present invention is to provide a drawer sliding mechanism as recited in claim 1 in which the intermediate rail is provided with a blocking member. Characterized in that the blocking member is provided with a plurality of blocking plates arranged in a corresponding manner, the space between two corresponding blocking plates allows the pressed plate to move freely in the lateral direction thereof. In addition, one end of the blocking plate is provided with a stair portion for retaining with the shoulder portion of the retaining plate. One end of the stair portion is extended to connect to a protruded point which can be opened or closed accordingly so as to enhance the alignment of the sliding rail and the intermediate rail. Furthermore, the drawer can be prevented from disengaging from the suspension of the sliding structure.

A further object according to the present invention is to provide a drawer sliding mechanism as recited in claim 1 of the claim wherein the blocking plate has a slanted surface provided on the opposite end of the protruded point. When the drawer is pushed in, the slanted surface pushes the retaining plate automatically so that the drawer can slide in quickly.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
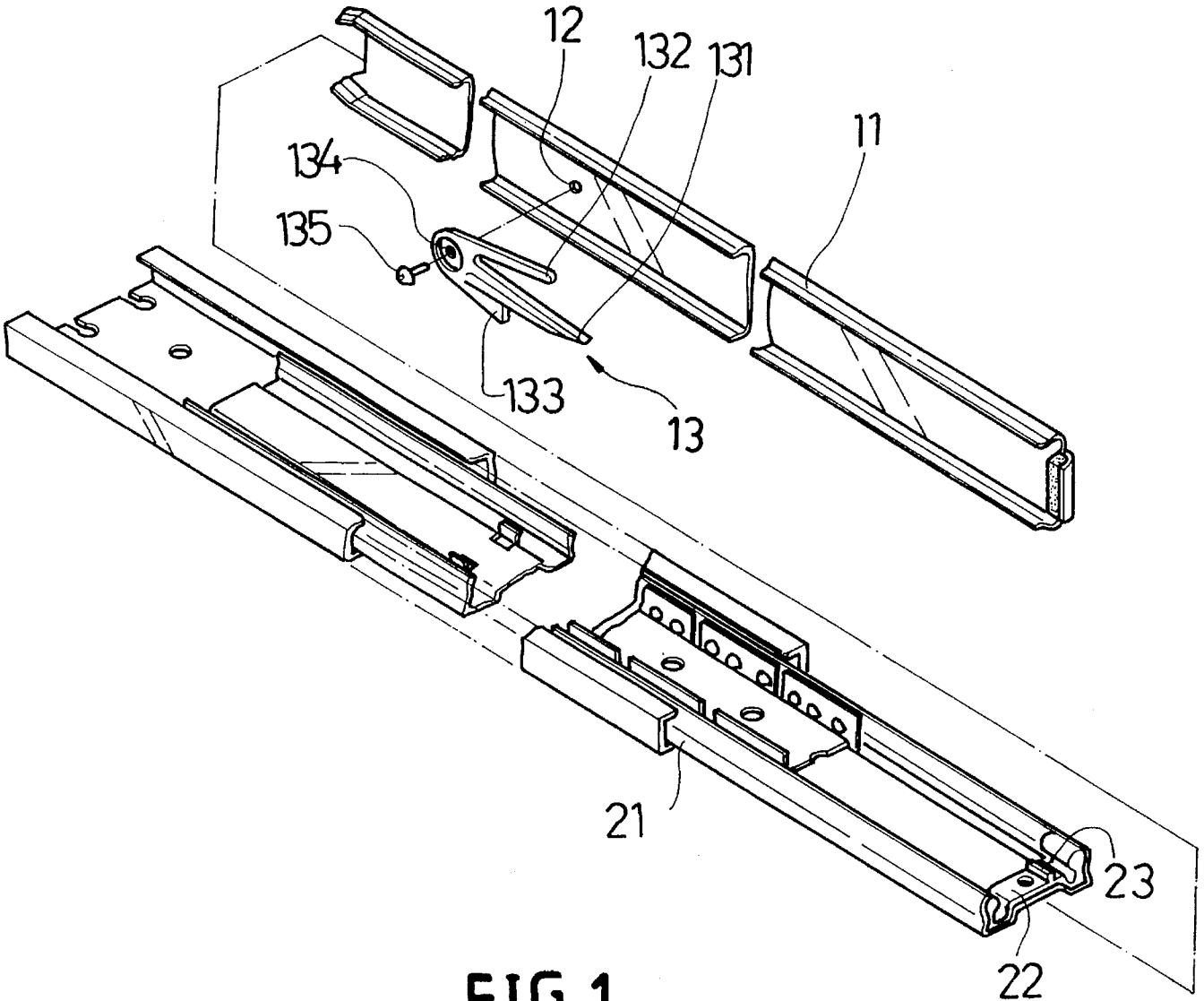
FIG. 1 is a perspective diagrammatic view of a conventional sliding mechanism for used in drawers.
Figure 2A:
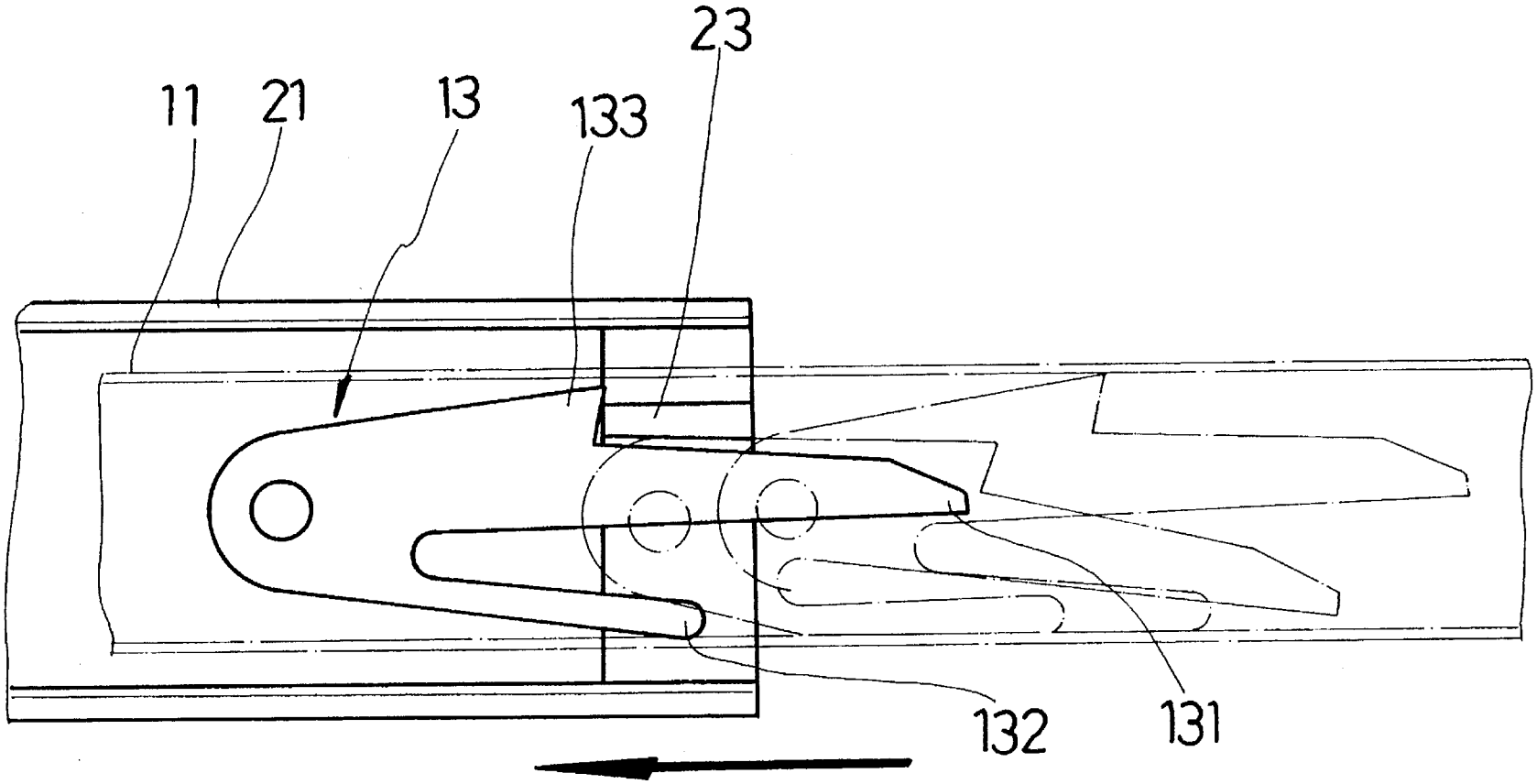
FIG. 2A and 2B are diagrammatic views showing the operation of the above conventional sliding drawer mechanism.
Figure 2B:
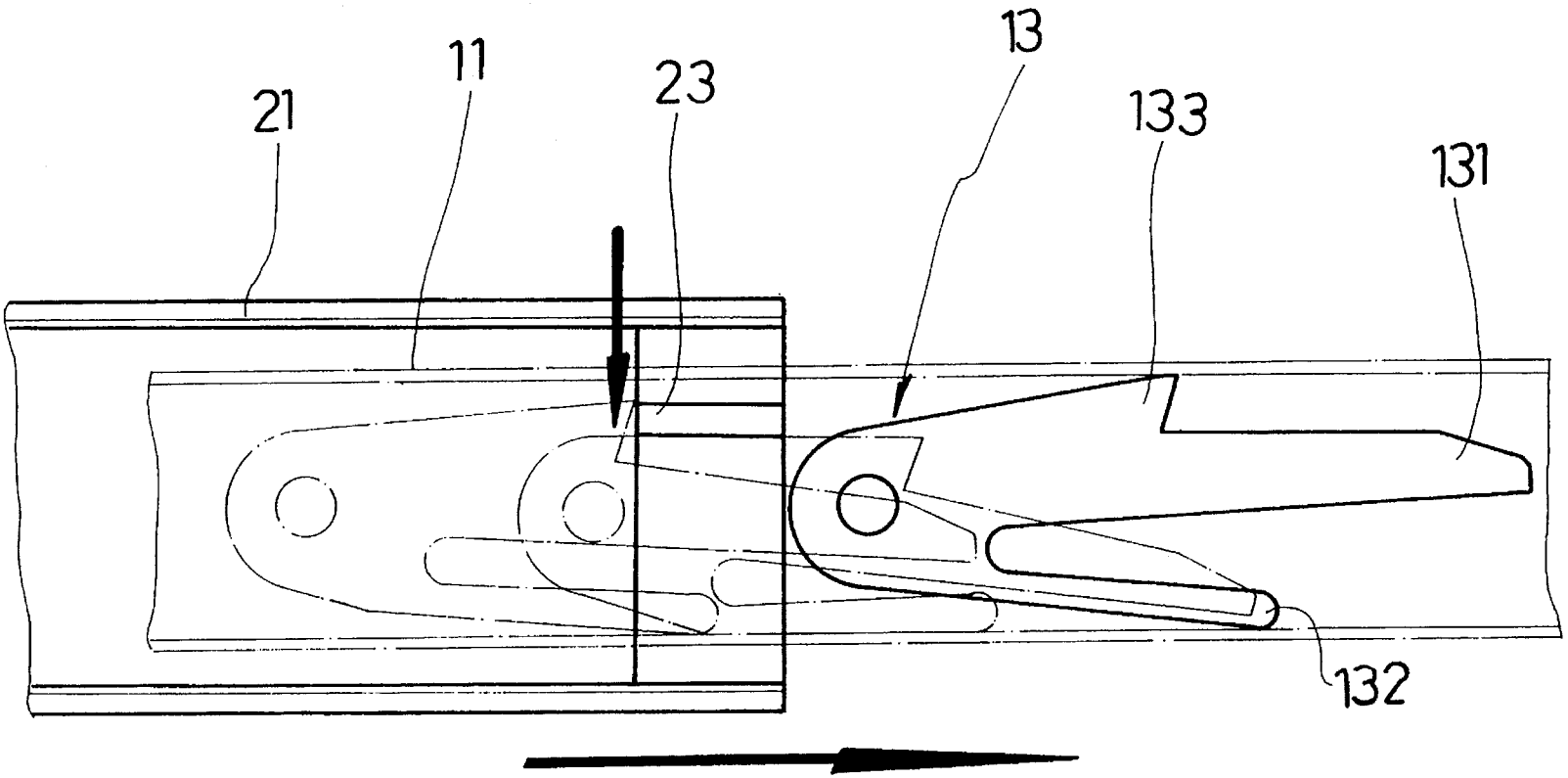
Figure 3:
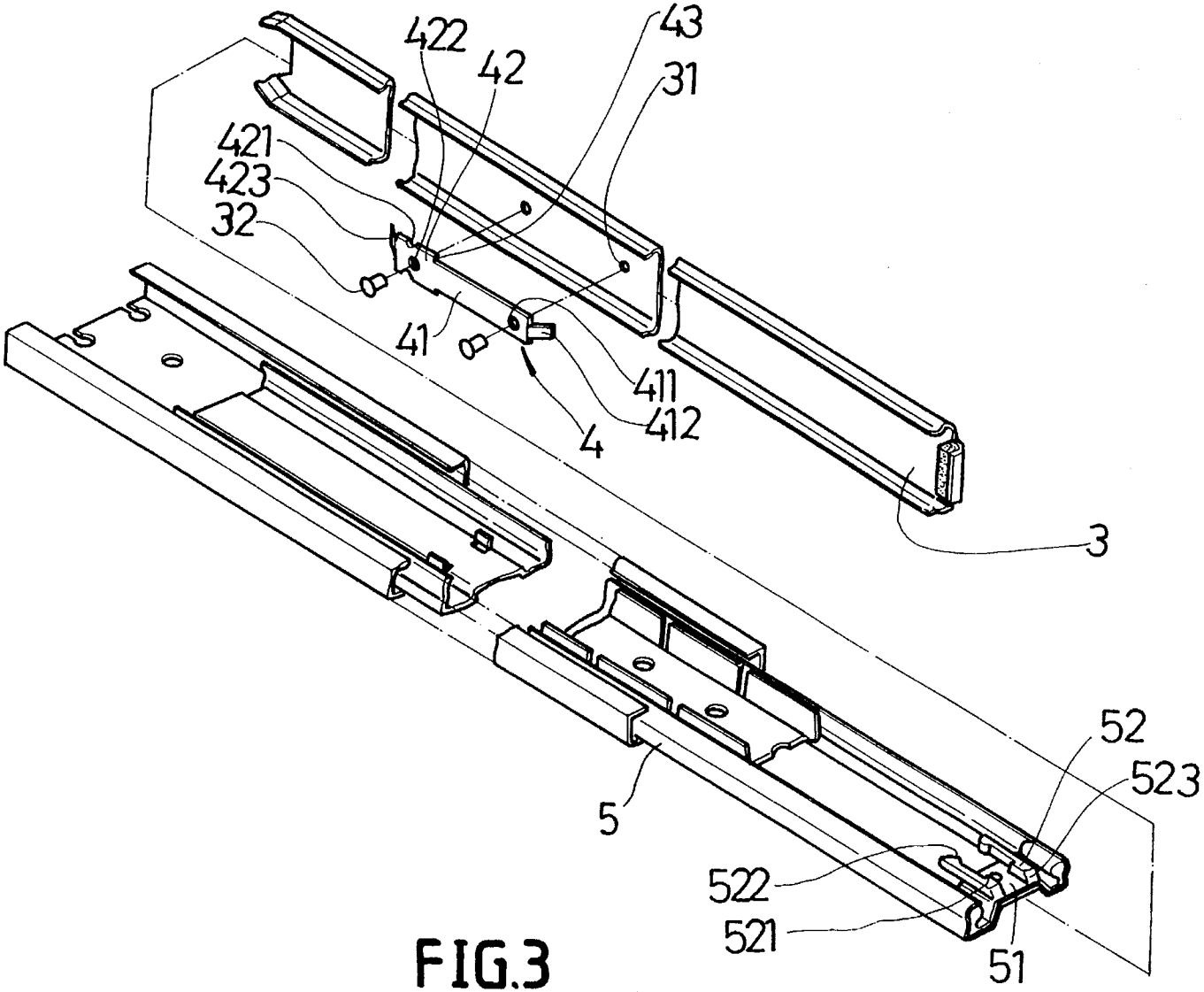
FIG. 3 is a perspective diagrammatic view showing a preferred embodiment of the sliding drawer mechanism according to the present invention.

As shown in the preferred embodiment in the perspective diagrammatic view in FIG. 3, the sliding drawer mechanism according to the present invention mainly consists of a sliding rail (3), a retaining plate (4) and an intermediate rail (5).

The sliding rail (3) is formed into an appropriate shape and is provided with a plurality of securing holes (31) in appropriate positions. The retaining plate (4) is secured onto the securing holes (31) by fasteners (32) such that it is movable along the axial direction of the fasteners (32).

The retaining plate (4) is formed into a one-piece body by a pressed plate (41) and a blocked plate (42). The pivotal joint of the pressed plate (41) and the blocked plate (42) is formed into a shoulder portion (43). The blocked plate (42) is provided with slits (421) in appropriate corresponding locations on the two edges. (The slits shown in the Figure are provided in arc shapes.) Moreover, the blocked plate (42) and the pressed plate (41) are provided, in the appropriate locations, with positioning holes (422) and (421) respectively. The number of the positioning holes are equal to the number of the securing holes (31) so that they can receive and allow the fasteners (32) to feed through. In addition, the two ends of the pressed plate (41) and the blocked plate (42) are extended and provided with symmetrical resilient plates (412) and (423). The two ends of the resilient plates (412) and (423) come in contact with the internal surface of the sliding rail (3), urging the retaining plate (4) so that the latter is kept at an appropriate distance from the internal surface of the sliding rail (3). In addition, the place where the resilient plate (423) and the blocked plate (42) joins together is provided with a slanted surface, however, this surface is not shown in the Figure.

The intermediate rail (5), having an appropriate shape, is provided with a blocking member (51) which has a plurality of blocking plates (52) protruded in appropriate positions. One end of the blocking plate (52) is provided with a stair portion (521) for retaining with the shoulder portion (43) of the retaining plate (4). One end of the stair portion (521) is extended to connect to a protruded point (522) which can be opened or closed accordingly, so that the protruded point (522) can be confined within the slit (421) of the retaining plate (4). Characterized in this configuration is that the two corresponding blocking plates (52) maintain a distance into which the pressed plate (41) is movably contained in the lateral direction. The blocking plate (52) has a slanted surface (523) provided on the opposite end of the protruded point (522).

Figure 4:
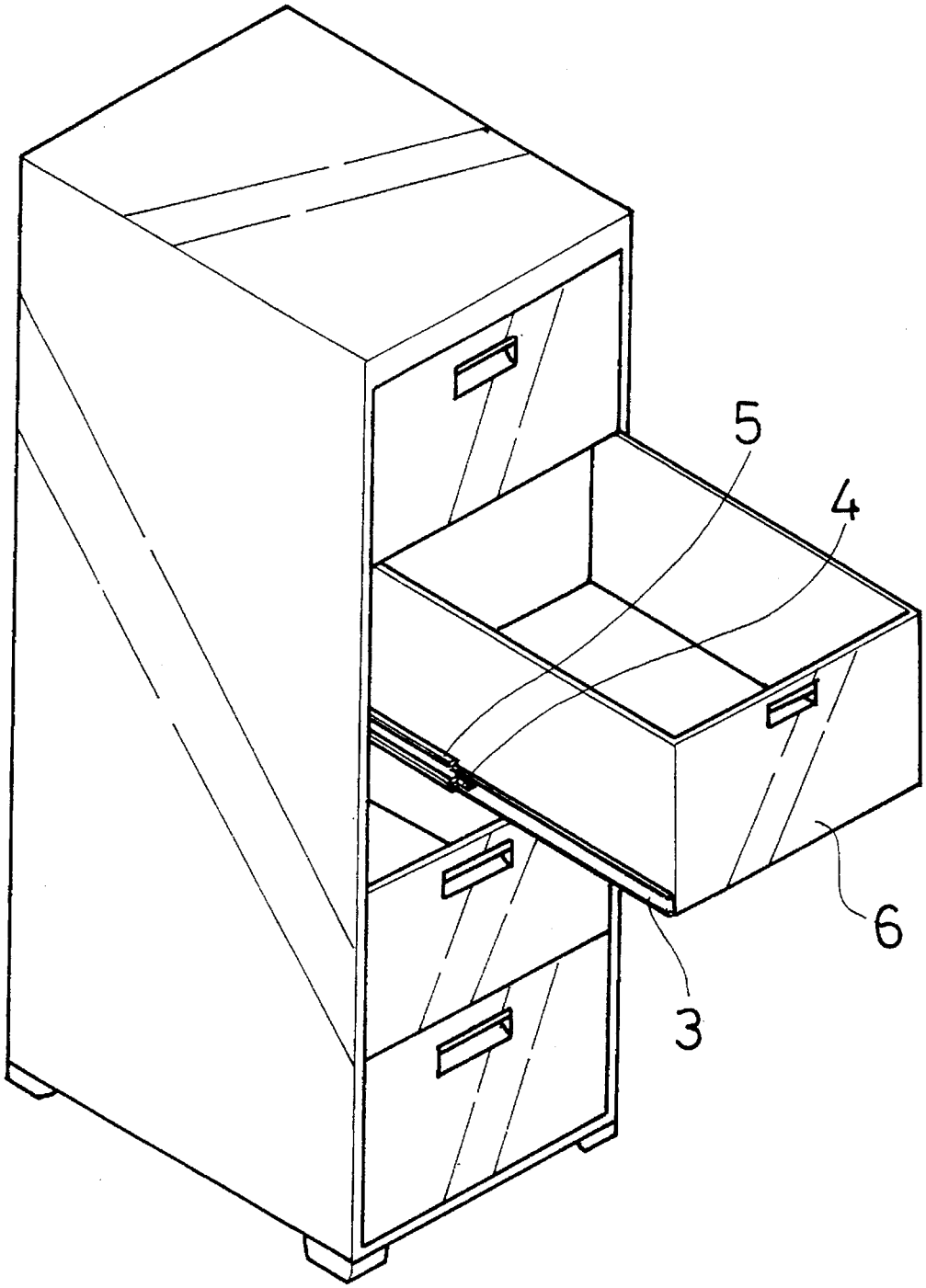
FIG. 4 is a diagrammatic view of a preferred embodiment of the invention when it is put together in a file cabinet for operation.

FIG. 4 is shows the preferred embodiment according to the present invention is used for sliding the drawers in a file cabinet. The sliding rails (3) are securely mounted on the sides of the second drawer. A retaining plate (4) is provided with each of the sliding rail (3) and the intermediate rail (5) is provided in an appropriate reserved space of the cabinet.

Figure 5B:
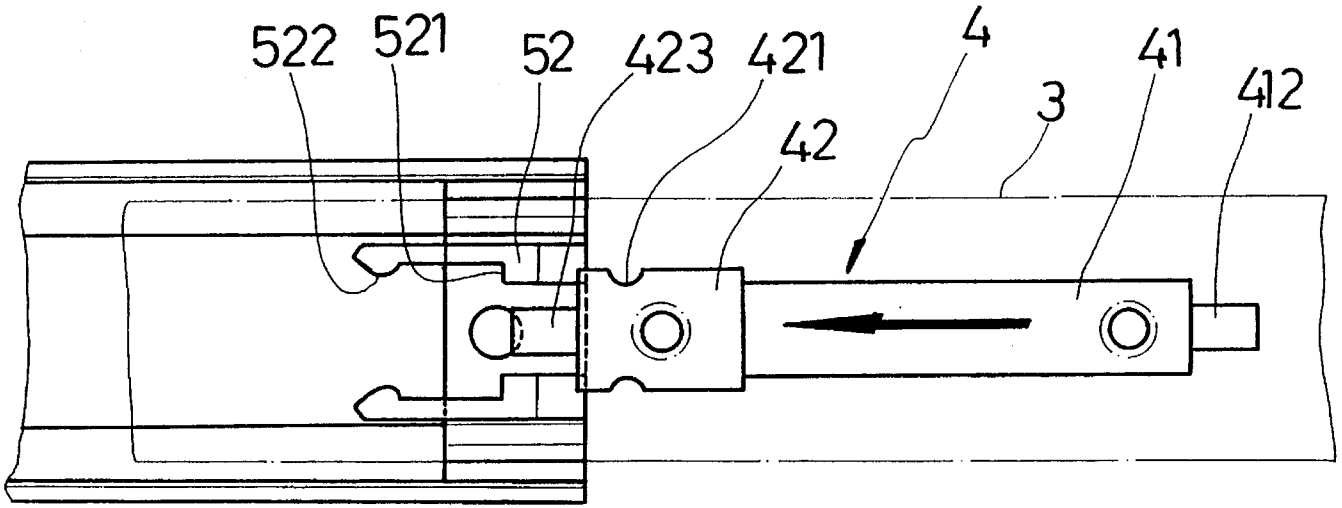
FIG. 5B is a fragmentary top view of FIG. 5A.
Figure 5A:
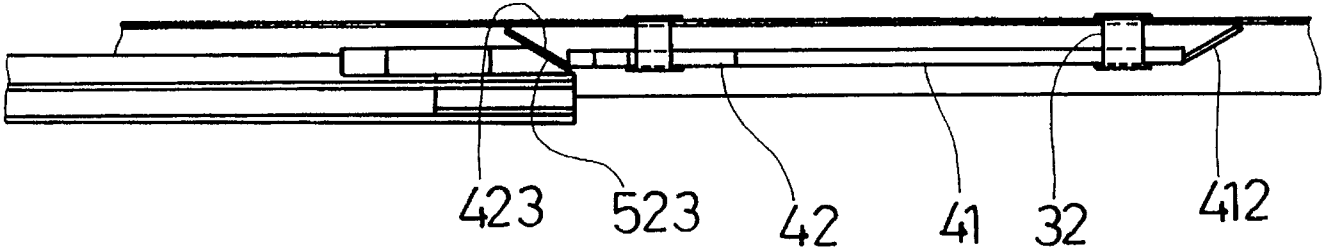
FIG. 5A is a side diagrammatical view.
Figure 6B:
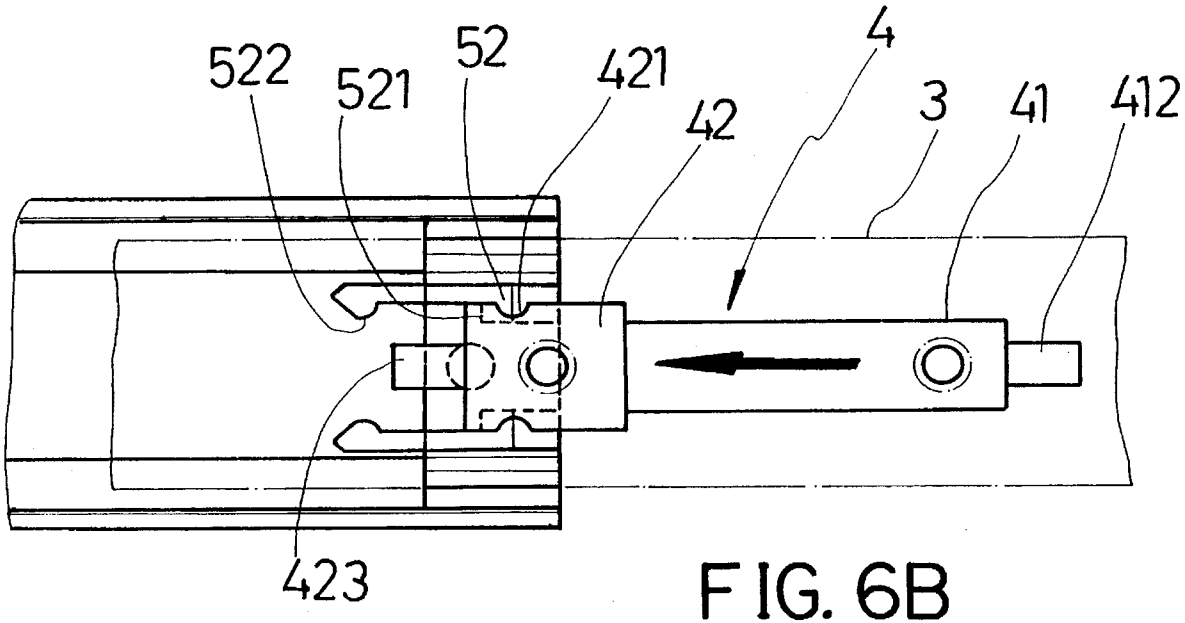
FIG. 6B is a fragmentary top view of FIG. 6A.
Figure 6A:
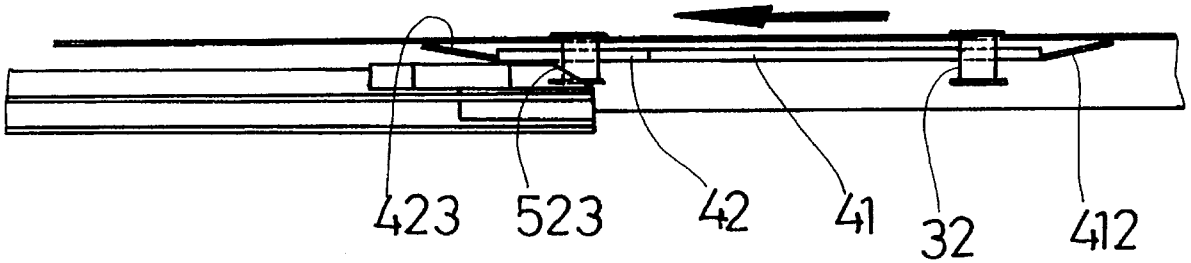
FIG. 6A is a side diagrammatical view.
Figure 7B:
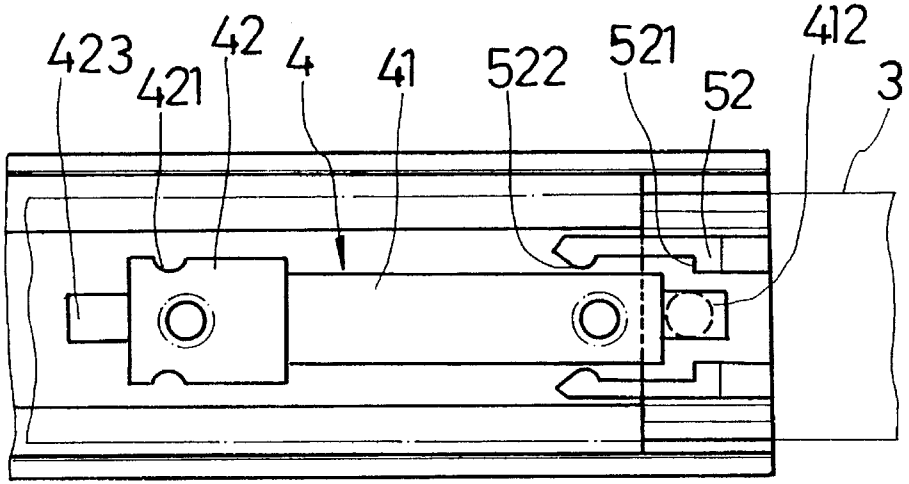
FIG. 7B is a fragmentary top view of FIG. 7A.
Figure 7A:
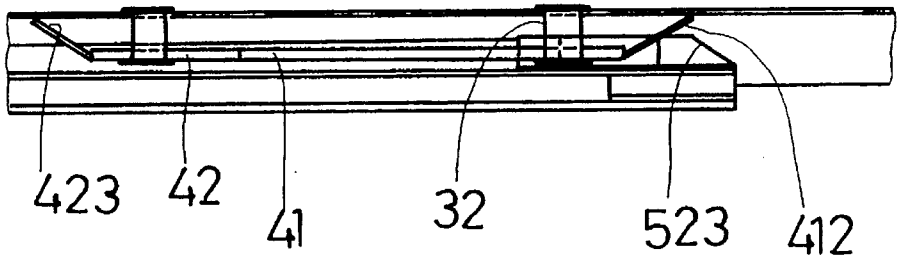
FIG. 7A is a side diagrammatical view.
Figure 8B:
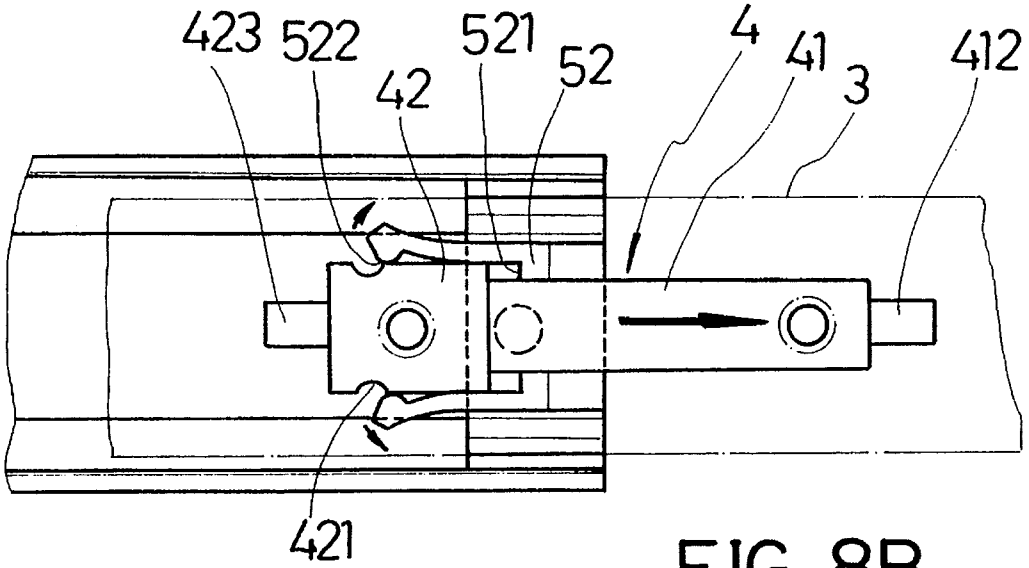
FIG. 8B is a fragmentary top view of FIG. 8A.
Figure 8A:
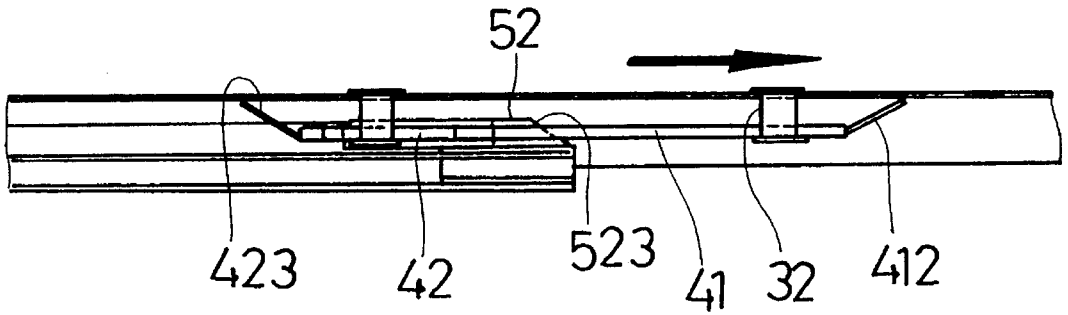
FIG. 8A is a side diagrammatical view.
Figure 9B:
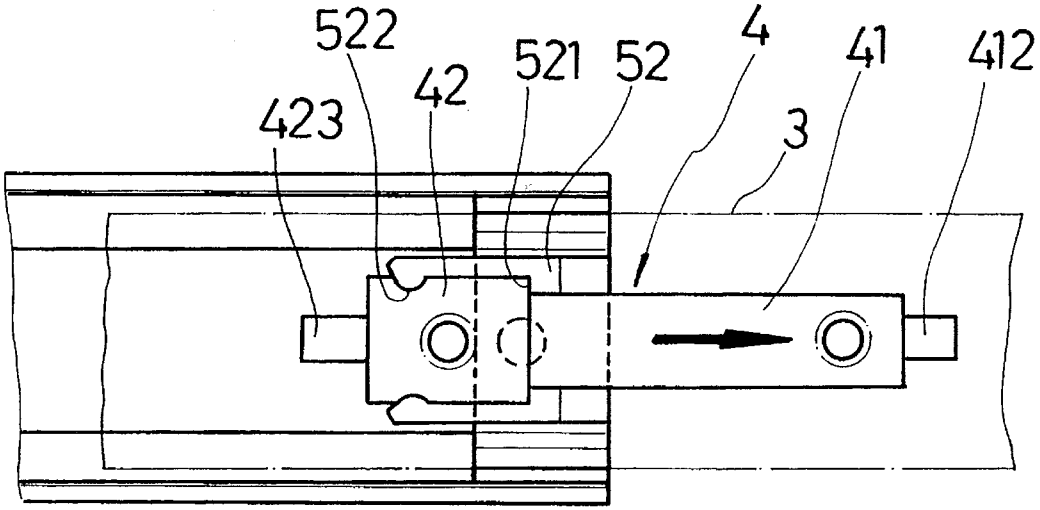
FIG. 9B is a fragmentary top view of FIG. 9A.
Figure 9A:
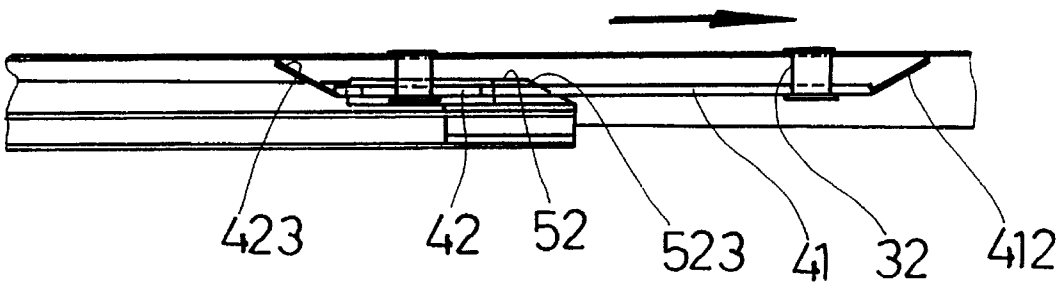
FIG. 9A is a side diagrammatical view.
Figure 10B:
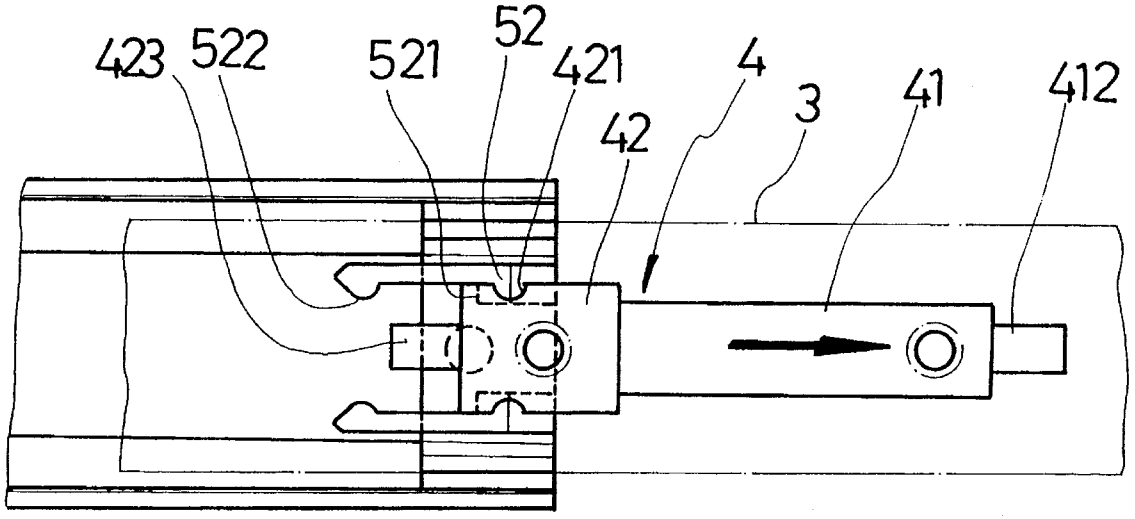
FIG. 10B is a fragmentary top view of FIG. 10A.
Figure 10A:
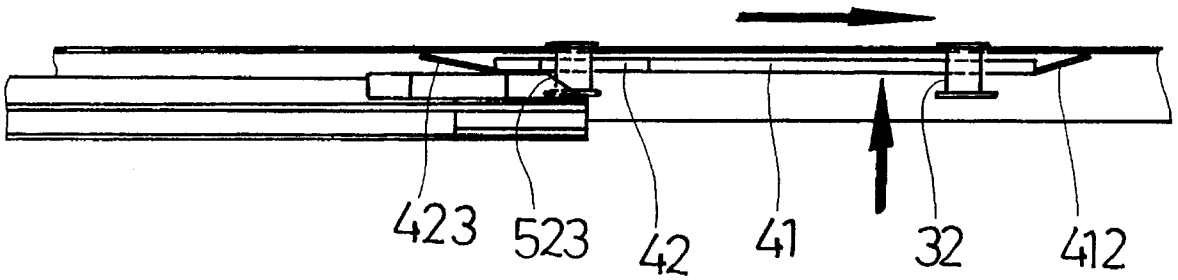
FIG. 10A is a side diagrammatical view.
Figure 11B:
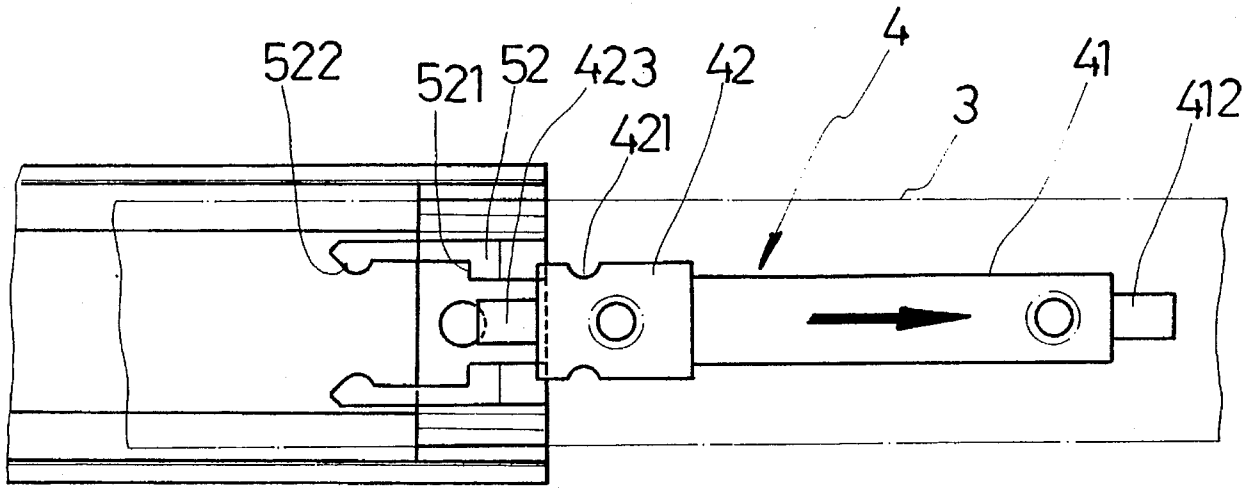
FIG. 11B is a fragmentary top view of FIG. 11A.
Figure 11A:
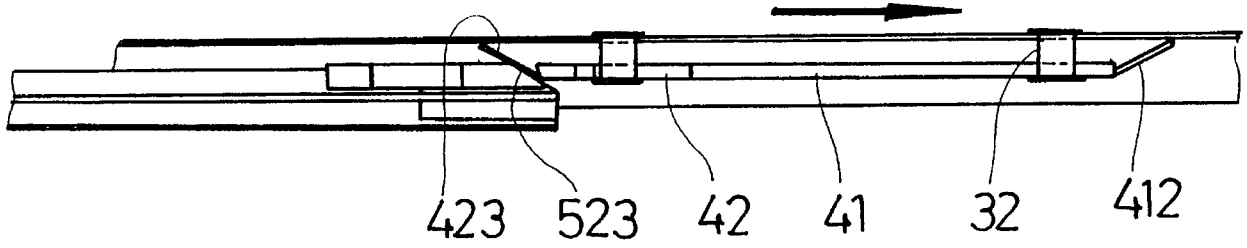
FIG. 11A is a side diagrammatical view.

Please continue to follow the illustrations in FIGS. 5 for the operation of the sliding mechanism of the present invention. When the sliding rail (3) slides into the intermediate rail (5), the resilient plate (423) connected to the blocked plate (42) of the retaining plate (4) comes in contact with the top edge of the slanted surface (523) of the blocking plate (52), as is shown in FIGS. 5A through 5C. If the retaining plate (4) is pushed forward, it is urged by the slanted surface (523) of the blocking plate (52) to move towards the sliding rail (3), passing through the blocking member (51) so that the sling rail (3) can slide into the intermediate rail (5).

As shown in FIGS. 5D through 5G, when the drawer (6) is pulled out completely, the pressed plate (41) of the retaining plate (4) slides in between the two blocking plates (52) such that the shoulder portion (43) is retained with the stair portion (521) of the blocking plate, preventing a disengagement of the sliding rail (3) from the intermediate rail (5). At this time, the protruded point (522) of the blocking plate (52) is retained with the slit (421) of the blocked plate (42), thereby preventing the sliding rail (3) to displace towards the internal edge. By retaining the shoulder portion (43) and the slit (421) with the stair portion (521) and the protruded point (522) respectively, the sliding rail (3) is assured to be secured with the intermediate rail (5). When the position of the sliding rail (3) needs to be restored, all it needs is to push so that the protruded point (522) disengages from the slit (421). The operation is simple and convenience.

If the drawer (6) needs to be pulled out completely, then the pressed plate (41) is pressed so that it displaces along the axial direction of the fastener (32) towards the internal surface of the sliding rail (3), thereby allowing the shoulder portion (43) to be disengaged from the stair portion (521). At this time the drawer can be pulled out completely.

In summary, the sliding mechanism for drawers according to the present invention is convenient and simple to use. The drawer can be positioned and fully suspended in place. The drawbacks of the conventional sliding mechanism are overcome. The requirements for patents and inventions are met and a claim is hereby made in compliance with the law.

What is claimed is:

1. A steel ball bearing type sliding mechanism for drawers comprising:

a sliding rail, a retaining plate, and an intermediate rail characterized in that:

said sliding rail is formed into an appropriate shape and is provided with a plurality of securing holes in appropriate positions, a retaining plate is secured onto the securing holes by fasteners;

said retaining plate is formed into a one-piece body by a pressed plate and a blocked plate, the width of the pressed plate is made to be smaller than the width of the blocked plate, the pivotal joint of the pressed plate and the blocked plate is formed into a shoulder portion, the blocked plate and the pressed plate are provided, in the appropriate locations, with positioning holes respectively, the number of the positioning holes are equal to the number of the securing holes, in addition, the two ends of the pressed plate and the blocked plate are extended and provided with resilient plates;

said retaining plate is movable along the axial direction of the fasteners, the two ends of the resilient plates come in contact with the internal surface of the sliding rail, urging the retaining plate so that an appropriate distance is maintained between the retaining plate and the internal surface of the sliding rail;

said intermediate rail, having an appropriate shape, is provided with a blocking member on one side of the open end, at least one blocking plate is provided protruding from an appropriate position of the blocking member, one end of the blocking plate is provided with a slanted surface;

by such configuration, when the retaining plate is moved to the blocking member, its shoulder portion is retained by the blocking plate, by pressing the retaining plate disengages it from the blocking plate, when the position of the retaining plate is restored, the slanted surface of the blocking plate pushes the retaining plate automatically so that the sliding rail is positioned securely into the intermediate rail with ease.

2. A sliding mechanism for drawers as recited in claim 1 wherein the two sides of the blocked plate are provided with a plurality of slits in the appropriate positions, one end of the blocking plate is provided with a stair portion for interlocking with the shoulder portion of the retaining plate, one end of the stair portion is extended to connect to a protruded point which can be opened or closed accordingly, so that the protruded point can be confined within the slit of the retaining plate.

3. A sliding mechanism for drawers as recited in claim 2 characterized in that the place where the resilient plate and the blocked plate joins together is provided with a slanted surface such that the slanted surface of the blocking plate can push the retaining plate quickly for displacement.

4. A sliding mechanism for drawers as recited in claim 2 characterized in that the slits of the blocked plate can either be a "V" shape or a semi-arc shape.

* * * * *